US005491984A

United States Patent [19]

Loch

[11] Patent Number: 5,491,984

[45] Date of Patent: Feb. 20, 1996

[54] RING SHAPED MEMBER FOR HAND WEAR

[76] Inventor: Thea L. Loch, 465 Norman St., Roselle, Ill. 60172

[21] Appl. No.: 209,116

[22] Filed: Mar. 9, 1994

[51] Int. Cl.[6] ..... A44C 5/00; A44C 15/00

[52] U.S. Cl. ..... 63/2; 2/160; 2/162; 2/170; 63/3; 63/11; D11/3; D11/4; D11/27

[58] Field of Search ..... 2/158, 159, 160, 2/161.3, 161.4, 162, 170, 167, 169; 63/2, 3, 11, DIG. 3; D11/3, 4, 27; 446/26, 27; 482/44, 49

[56] References Cited

U.S. PATENT DOCUMENTS

| | | | |
|---|---|---|---|
| 2,086,493 | 7/1937 | Ellingwood | 63/3 |
| 2,189,096 | 2/1940 | Alonge | 63/2 |
| 4,936,699 | 6/1990 | Yoshida | 63/11 |

FOREIGN PATENT DOCUMENTS

| | | | |
|---|---|---|---|
| 604177 | 4/1926 | France | 63/3 |
| 5184415 | 7/1993 | Japan | 63/2 |
| 1210385 | 10/1970 | United Kingdom | 63/11 |

*Primary Examiner*—Jeanette E. Chapman
*Attorney, Agent, or Firm*—Charles F. Meroni, Jr.

[57] ABSTRACT

This invention concerns a ring shaped member for hand wear on a hand of a person which comprises an inner ring shaped section and an upper ring shaped section, the inner ring section having an inwardly bulged ring shaped area bulged in a direction towards the upper ring shaped section for nested contact with hand palm skin covering bodies of metacarpals of a person's hand palm for enabling the ring shaped member to snugly fit around a hand of a person with an upper section of the ring shaped member being snugly engageable with a top hand surface of the hand on an opposite side of the metacarpals on the person's hand, the ring shaped member having an interior ring shaped surface including the upper and inner ring shaped sections which are shaped for snug fitted engagement about a person's hand with the inwardly bulged area serving to lock with an identical area of the hand palm to assist in holding the ring shaped member in place on the hand of a person.

15 Claims, 3 Drawing Sheets

RING SHAPED MEMBER FOR HAND WEAR

BACKGROUND OF THE INVENTION

It is a known fact that many woman dislike to wear bracelets because their wrists are too small or too large. Notwithstanding this fact, it is also known that woman are always looking for more jewelry that will look elegant. In the past it has also been known that ladies enjoy wearing rings on some or many fingers as another way to increase the attractiveness of their hands.

According to my invention, I have developed a still further way for decorating women's hands by the creation of a new type of decorative hand wear which I have herein described as a ring shaped member or C-shaped member for hand wear. According to my invention, this decorated member can be provided with jewelry or diamonds or pearls or even a wristwatch as desired and such components can be attached to an outer surface of my ring shaped or C-shaped member for hand wear as herein disclosed. In order to mount the ring shaped or C-shaped member onto the hand I have not only developed a new configuration for my ring shaped or C-shaped member but also a new way for securing the same to a person's hand. To this end, I have formed an inner section with an offset area for offset ends so that the offset section or ends can be snugly engaged into nested contact with hand palm skin in a general area of a superficial palmar arch in a person's hand palm for enabling the ring shaped member or C-shaped member to snugly fit around a hand of a person with an upper section of the same being snugly engageable with a top end surface of the hand just above metacarpals on the person's hand.

It is believed that my new decorated ring shaped or C-shaped member will be worn by various people for the following reasons: clothing does not hide it, it does not accent small or large wrists, it looks elegant, the jewelry industry is looking for something new and unique, and it provides something for a person's hand that gives a feeling of security for some people.

The prior art shows a number of different types of bracelets for wrist wear and bracelets by definition are only adapted for wrist wear. In this connection attention is directed to such prior art patents as U.S. Pat. No. 19,814 issued on Mar. 30, 1858 which invention entitled "Hand Exerciser for Musicians" shows a bracelet simulating device for wrist wear. Other bracelets are shown in a number of different patents including various types of wrist watches. Attention is directed to still other patents which show wrist wear having a wrist identification tag such as in U.S. Pat. No. 1,151,940. Still another prior art device is entitled a "Dentifrice Package" found in U.S. Pat. No. 1,955,175 which shows a tray type member having a curved end for hand engagement which is only adapted to receive dentifrice in a pocket provided in the tray for disposition in a person's hand palm.

Another patent, U.S. Pat. No. 2,149,794, shows a signaling device which is generally C-shaped and has opposite ends provided with pad like members engaged on opposite sides of a person's palm with one end in the palm and the other in the back side of the hand. This signaling device does not lend itself for use as a decorated ring shaped or C-shaped member for hand wear so as to be capable of performing the purpose and function of my new decorated ring or C-shaped member. The prior art also shows other types of athletic devices for attachment to a hand and, in this connection, attention is directed to U.S. Pat. No. 3,496,573, 3,640,532, 4,456,002, and 4,711,445. None of these patents are usable for purposes of my invention as they are specifically designed and constructed for athletic purposes or as hand exercisers.

It is therefore an object of this invention to provide a decorated ring shaped or C-shaped member for hand wear on the hand of a person. It is another object of this invention to provide such new and improved decorated ring shaped or C-shaped member with an inwardly bulged or offset area that is bulged in a direction towards an upper ring shaped section which is adapted to engage on an upper or back side of a person's hand while the inwardly bulged or offset ring shaped area is adapted to engage in contact and upon skin covering a superficial palmar arch of a person's palm. Still another object of my invention is to provide ring shaped member of an elliptical shape. Yet another object of my invention is to provide an embodiment where the member is of a C-shaped configuration with the member having adjacent ends, the ends having offset or bulged areas which are engageable with the superficial palmar arch in the hand palm to resist movement of the member when worn on the hand of a person.

Other objects and advantages of my invention will become apparent through the following specification and claims taken in conjunction with the accompanying drawings.

SUMMARY OF THE INVENTION

My invention provides for a ring shaped member for hand wear on a hand of a person which comprises an inner ring shaped section and an upper ring shaped section, the inner ring section having an inwardly bulged ring shaped area bulged in a direction towards the upper ring shaped section for nested contact with hand palm skin covering bodies of metacarpals of a person's hand palm for enabling the ring shaped member to snugly fit around a hand of a person with an upper section of the ring shaped member being snugly engageable with a top hand surface of the hand on an opposite side of the metacarpals on the person's hand, the ring shaped member having an interior ring shaped surface including the upper and inner ring shaped sections which are shaped for snug fitted engagement about a person's hand with the inwardly bulged area serving to lock with an identical area of the hand palm to assist in holding the ring shaped member in place on the hand of a person.

An additional feature of my invention includes a decorated ring shaped member wherein the inwardly bulged ring shaped area is elongated and centrally located and extended in a direction towards the upper ring shaped section but being radially spaced therefrom.

Yet another feature of my invention provides for a decorated ring shaped member that is of an elliptical shape.

It is also contemplated that my invention provides for a decorated ring shaped member that is in the form of a closed annulus.

Still contemplated by my invention is a decorated ring shaped member being generally of C-shaped configuration, the C-shaped configuration having adjacent ends with the bulged ring shaped area being located at each of the ends with the ends being engageable within the superficial palmar arch in the hand palm to resist movement of the ring shaped member when worn on the hand of a person.

Another object of my invention is to provide a decorated ring shaped member that is comprised and constructed of a synthetic plastic material or more traditional materials suited for jewelry such as gold, silver, bronze, copper, brass, tin, and platinum.

It will also be appreciated that my invention further involves an annulus for hand wear on a hand of a person which comprises an inner annulus section having a bulged annulus area for nested contact with hand palm skin in a general area of a superficial palmar arch in a person's hand palm for enabling the annulus to snugly fit around a hand of a person with an upper section of the annulus being snugly engageable with a top hand surface of the hand adjacent to metacarpals on the person's hand. The annulus has an interior annular annulus surface including the upper and inner ring annular sections which are shaped for snug fitted engagement about a person's hand with the bulged annulus area serving to lock with the superficial palmar arch in the hand palm to assist in holding the annulus in place on the hand of a person.

Yet other features of my invention relate to an annulus that can be of a number of selectable materials including synthetic plastic as well as more traditional metals used in forming jewelry such as gold, silver, bronze, copper, brass, platinum, and tin.

A still further feature of my invention relates to a decorative C-shaped hand clasping member for hand wear on a hand of a person which comprises an inner section and an upper section, the inner section having an inwardly bulged area bulged in a direction towards the upper section for nested contact with hand palm skin covering bodies of metacarpals of a person's hand palm for enabling the member to snugly fit around a hand of a person with an upper section of the clasping member being snugly engageable with a top hand surface of the hand on an opposite side of the metacarpals on the person's hand, the clasping member having an interior surface including the upper and inner sections which are shaped for snug fitted engagement about a person's hand with the inwardly bulged area serving to lock with an identical area of the hand palm to assist in holding the clasping member in place on the hand of a person, the C-shaped hand clasping member having adjacent ends, the bulged area being located at each of the ends with the ends being engageable within a superficial palmar arch in the hand palm to resist movement of the member when worn on a hand of a person.

DESCRIPTION OF THE PREFERRED EMBODIMENT

Figure 1:
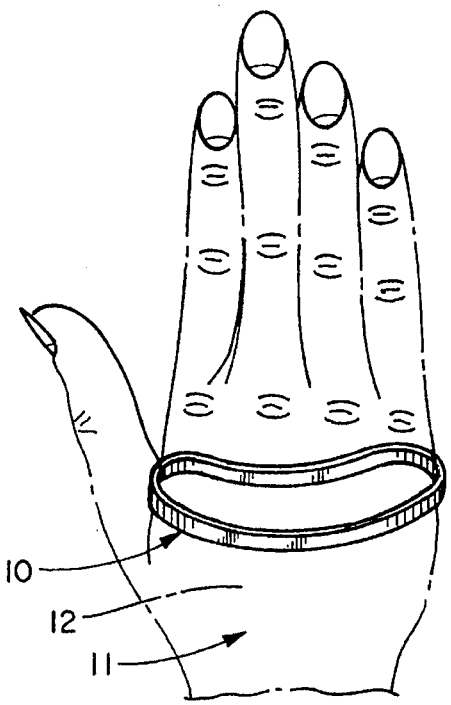
FIG. 1 is a perspective view of a human hand showing my decorated ring shaped member mounted upon the human hand of a user according to important features of my invention.
Figure 2:
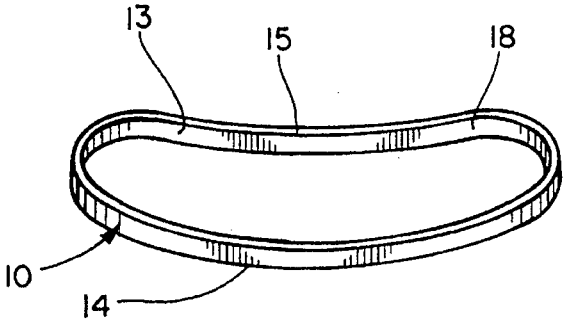
FIG. 2 is a perspective view of my decorated ring shaped member depicting important features of my invention.

According to my invention I have provided a decorated ring shaped member 10 to be worn on the hand 11 of a person. The member 10 is illustrated as extending across a backside 12 of a hand in FIG. 1. This member 10 comprises an inner ring shaped section 13 and an upper ring shaped section 14 as seen in FIG. 2. The inner ring shaped section 13 has an inner bulged or offset ring shaped area 15 that is bulged in a direction towards the upper ring shaped section 14 for nested contact with hand palm skin covering a superficial palmar arch 16 of a person's hand 11 for enabling the ring shaped member 10 to snugly fit around the hand 11 of a person. The upper section 14 of the ring shaped member 10 is snugly engageable with a top hand surface or backside 12 of the hand 11 just above metacarpals 17 on the person's hand 11. The ring shaped member 10 has an interior ring shaped surface 18 including the inner and upper ring shaped sections 13 and 14 which are shaped for snug engagement upon a person's hand 11, the inner bulged area 15 serving to lock with the superficial palmar arch 16 in the hand 11 to assist in holding the ring shaped member 10 in place on the hand 11 of a person.

As will be seen in the drawings, the inner bulged shaped area 15 is elongated and centrally located and extended in a direction towards the upper ring shaped section 14 but positioned in radially spaced relation therefrom. In the embodiment shown in FIGS. 1 and 2 it will be seen that the ring shaped member 10 is of an elliptical shape and comprises a closed annulus.

Figure 6:
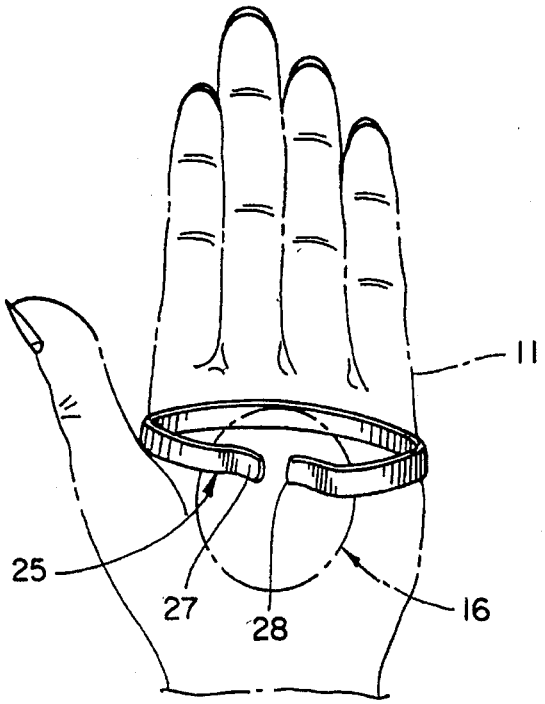
FIG. 6 is a perspective view of a palm of a hand showing by C-shaped or ring shaped member for hand wear.
Figure 7:
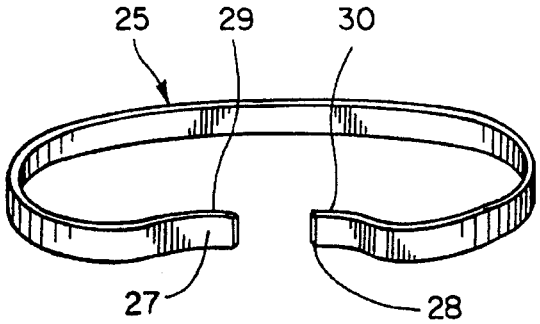
FIG. 7 is a perspective view of the C-shaped member shown in FIG. 6.

This ring shaped member 10 can be comprised of a suitable synthetic plastic, gold, silver, bronze, copper, brass, platinum, tin and porcelain and possibly other materials but these are the ones that are believed to be most suitable for my purpose of providing an attractive decorative ring shaped member 10. The term ring shaped member as used in this document has been used in a generic sense to define a closed ring as well as a open ring member such as a C-shaped hand clasping member. The hand clasping member is shown in FIGS. 6 and 7 and will be further described hereafter.

Figure 3:
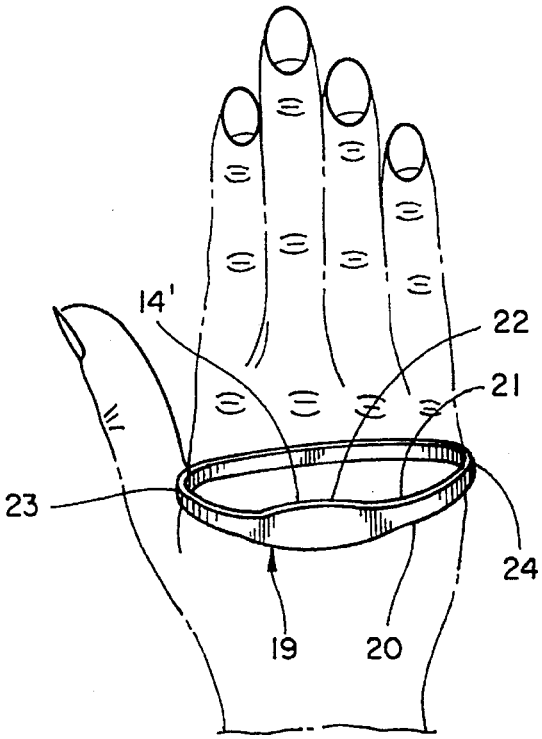
FIG. 3 is a perspective view of a modified type of my decorated ring shaped member mounted upon a human hand.

It will be seen also that in one modified version of my decorated ring shaped member 10 shown in FIG. 3 there is provided a modified type of a ring shaped member 19, as such I have provided opposed edges 20 and 21 which face in opposite directions relative to one another. These edges 20 and 21 are stepped from a center area of upper ring shaped section 14' thus providing a tapered thickness with the thickest area being centrally located at 22 on the upper section 14' and with the ring shaped member 10 being thinnest at areas or points 23 and 24 where the ring shaped member 10 curves around opposite sides of the hand 11 increasing comfort for the wearer as shown in FIG. 3.

Figure 5:
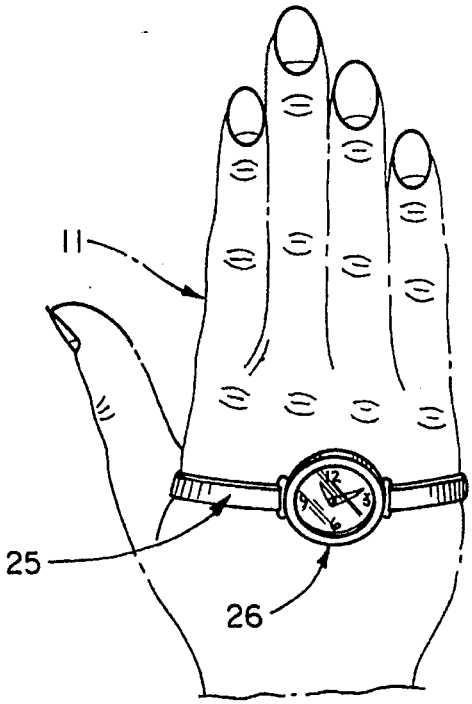
FIG. 5 is a top plan view of a C-shaped or ring shaped member for hand wear on a hand of a person with an ornamentation shown thereon.

Shown in FIG. 5 is another modification of my member 10 and is identified by the number 25. The member 25 may be decorated with a time piece 26 as shown in FIG. 5. The time piece 26 can be of any suitable type and can be attached in any suitable manner to the member or band 25.

This member 25 is C-shaped and has opposite ends 27 and 28 with the C being positioned so as to engage an underside of a person's palm. This C-shaped member 25 has opposite ends 27 and 28 which comprise inwardly offset or bulged areas 29 and 30 that are extended in a direction towards the upper ring shaped section 14 for snug engagement with a person's palm in a superficial palmar arch 16.

It should be understood that the ring shaped member 10 can be dimensioned to fit varied hand 11 sizes to accommodate variations in the sizes of the human hand 11 as found in the United States and elsewhere in the world. Each of the decorated ring shaped members 10 has an inner bulged or offset ring shaped area 15 that is bulged in a direction towards the upper ring shaped section 14 for nested contact with hand 11 palm skin covering the superficial palmar arch 16 of a person's palm of the hand 11 for enabling the ring shaped member 10 to snugly fit around the hand 11 of a person with an upper section 14 of the ring shaped member 10 being snugly engageable with a top hand 11 surface of the hand 11 just above metacarpals 17 on the person's hand 11 all as previously described.

Figure 4:
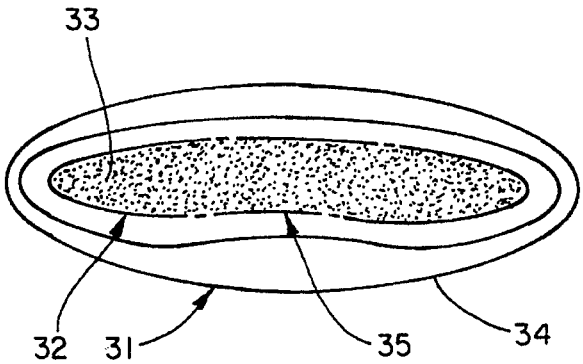
FIG. 4 is a diagrammatic view of a mold for manufacturing my decorated ring shaped member which particularly shows a technique for formation of the bulged ring shaped area according to features of my invention.

In FIG. 4 I have shown a mold for use in the formation of my decorated ring shaped member 10 where it is made out of a synthetic plastic. The mold is indicated by the number 31. This mold 31 has a center section 32. Inner and outer mold parts of the mold are indicated at 33 and 34 and designated by darker areas as seen in FIG. 4. The lighter colored area shows the area where my decorated ring shaped member 10 is formed. The inner mold portion 33 has a pocket or inset area located at 35 which enables the formation of the bulged or offset ring shaped area 15.

It is envisioned that the annulus of my invention would be worn by a great variety of people thus necessitating the annulus to come in the form of many different sizes to reflect the physical size of the wearer. In this manner, the full decorative effect of the annulus can be most effectively conveyed by the wearer. To achieve the capability of creating the annulus to fit all potential users, the following "Annulus Size Chart" was derived as a wearer's sizing guide. It will be appreciated that the following chart reflects those sizes of an annulus most commonly found in a group of "average" human users.

ANNULUS SIZE CHART
(All Sizes in cm)

| Palm Len. Size/cm. | Average Hw Edge | Hw Cen | Small Hw Edge | Hw Center | Large Hw Edge | Hw Center |
|---|---|---|---|---|---|---|
| 6 | 2.0 | 1.8 | 1.8 | 1.6 | 2.2 | 2.0 |
| 6.5 | 2.0 | 1.8 | 1.8 | 1.6 | 2.2 | 2.0 |
| 7 | 2.1 | 1.9 | 1.9 | 1.7 | 2.3 | 2.1 |
| 7.5 | 2.1 | 1.9 | 1.9 | 1.7 | 2.3 | 2.1 |
| 8 | 2.5 | 2.3 | 2.3 | 2.1 | 2.7 | 2.5 |
| 8.5 | 2.5 | 2.3 | 2.3 | 2.1 | 2.7 | 2.5 |
| 9 | 2.6 | 2.4 | 2.4 | 2.2 | 2.8 | 2.6 |
| 9.5 | 2.6 | 2.4 | 2.4 | 2.2 | 2.8 | 2.6 |

The handwidth (Hw) Edge and handwidth (Hw) Center measurements have a desired tolerance of +0.15 cm, while the palm length has desired tolerance of +0.4 cm.

With respect to the language that has been here employed, it is my intention to utilize the words ring shaped member and annulus in a generic sense to mean either a closed ring, a split ring or a C-shaped ring all as previously discussed in this specification. From a consideration of the drawings, it will be seen that the concept of providing a fitted ring shaped member or C-shaped member having a bulged area or an offset area to assist in ensuring that the ring shaped member or C-shaped member can engage a hand in snug fitted way so that it is relatively fixed on the hand. It should also be appreciated that it is within the scope of my invention and intended as part of my invention that the ring shaped member or C-shaped member shall be provided with precious stones, if desired to enhance the decorative appearance thereof.

Figure 8:
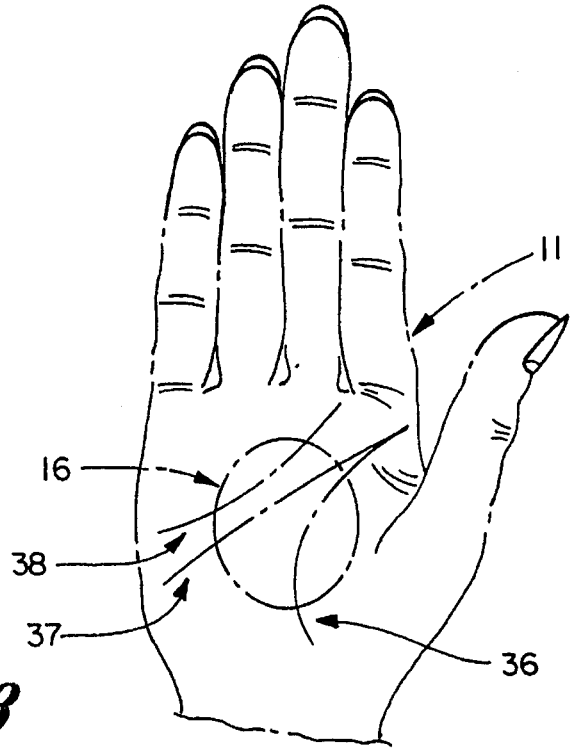
FIG. 8 is a perspective palmar view of a hand illustrating the location of a superficial palmar arch where the ring shaped member is adapted to engage in fitted nested relation.
Figure 9:
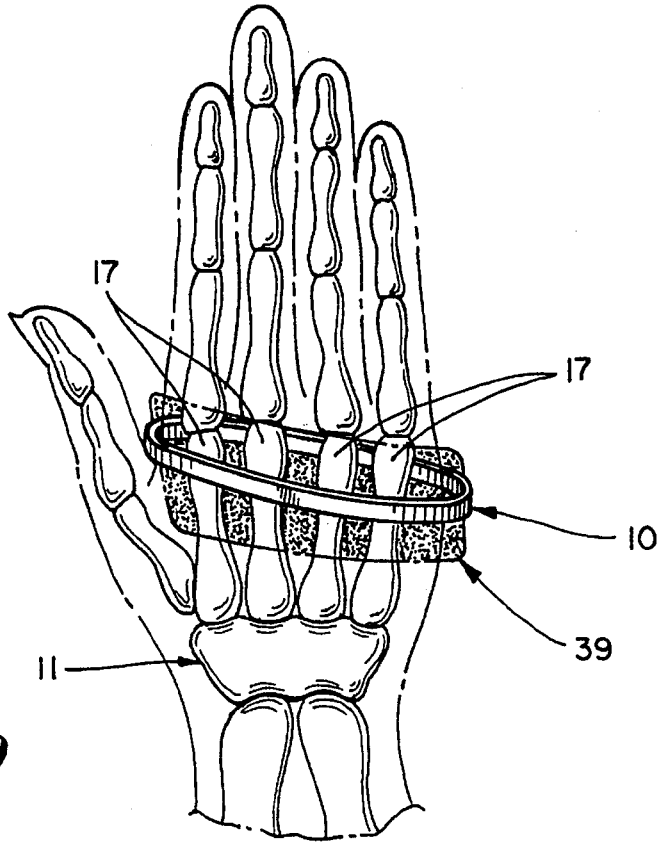
FIG. 9 is a radiograph of a dorsum of a hand showing the location of my decorated ring shaped or C-shaped member in relationship to the metacarpals.

FIGS. 8 and 9 show the location of the metacarpals as well as the superficial palmar arch. My ring shaped member extends across the metacarpals as illustrated in FIG. 9. My C-shaped hand clasping member is best shown in FIGS. 6 and 7. In this connection, opposite ends of the C are annularly spaced from one another and are positioned so as to engage a person's palm in the superficial palmar arch. These ends are offset to provide an inwardly bulged area with the bulge extending in a direction towards the upper section of the C-shaped member for snug engagement in the superficial palmar arch. The superficial palmar arch 16 is shown in FIG. 8 in approximate relation to the longitudinal crease 36, proximal crease 37, and distal crease 38 of the hand. A range 39 of possible positions for the ring shaped member 10 which are adjacent the metacarpals 17 are shown in FIG. 9.

While the preferred form of the invention has been specifically illustrated and described herein, it will be apparent to those skilled in the art that modifications and improvements may be made to the form herein specifically disclosed. Accordingly, the present invention is not to be limited to the form herein specifically disclosed or in any other way inconsistent with the progress in the art promoted by this invention.

I claim:

1. A ring shaped member in the form of a closed annulus for hand wear on a hand of a person which comprises an inner ring shaped section and an upper ring shaped section, the inner ring shaped section having an inwardly bulged ring shaped area bulged in a direction towards the upper ring shaped section for nested contact with hand palm skin covering metacarpals in a person's hand palm for enabling the ring shaped member to snugly fit around the hand of the person with the upper ring shaped section of said ring shaped member being snugly engageable with a top hand surface of the hand on an opposite side of the metacarpals on the hand, said ring shaped member having an interior ring shaped surface including the upper and inner ring shaped sections which are shaped for snug fitted engagement about the hand with said inwardly bulged ring shaped area serving to lock with an identical area of the hand palm to assist in holding said ring shaped member in place on the hand of the person.

2. The ring shaped member of claim 1 wherein said inwardly bulged ring shaped area being elongated and centrally located and extended in a direction towards said upper ring shaped section but being radially spaced therefrom.

3. The ring shaped member of claim 1 wherein the inner ring section is so positioned with respect to said upper ring shaped section so as to extend transversely of metacarpals on a person's hand between head and base ends of the metacarpals, thereby extending across a hand palm in proximity to a superficial palmar arch located on a person's hand palm.

4. The ring shaped member of claim 2 wherein said ring shaped member is of an elliptical shape.

5. The ring shaped member of claim 1 further comprising the ring shaped member carrying decorative shapes on an outer face of said upper ring shaped section.

6. The ring shaped member of claim 1 wherein said ring shaped member is comprised of a synthetic plastic.

7. The ring shaped member of claim 1 wherein said ring shaped member is comprised from a group consisting of synthetic plastic, gold, silver, bronze, copper, brass, platinum, tin, and porcelain.

8. An annulus for hand wear on a hand of a person in the form of a closed annulus which comprises an inner annulus section having a bulged annulus area for nested contact with hand palm skin covering metacarpals of a person's hand palm for enabling the annulus to snugly fit around the hand of the person, and an upper section of the annulus being snugly engageable with a top hand surface of the hand on an opposite side of the metacarpals on the person's hand, said annulus having an interior annular annulus surface including upper and inner ring annular sections which are shaped for snug fitted engagement about the hand with said bulged annulus area serving to lock with an identical area of the hand palm to assist in holding the annulus in place on the hand of the person.

9. The annulus of claim 8 wherein said annulus is comprised of a synthetic plastic.

10. The annulus of claim 8 wherein said annulus is comprised from a group consisting of synthetic plastic, gold, bronze, copper, brass, platinum, tin and porcelain.

11. The annulus of claim 8 wherein the inner ring section is so positioned with respect to said upper ring shaped section so as to extend transversely of metacarpals on a person's hand between head and base ends of the metacarpals, thereby extending across a hand palm in proximity to a superficial palmar arch located on a person's hand palm.

12. A decorative C-shaped hand clasping member for hand wear on a hand of a person which comprises an inner section and an upper section, the inner section having an inwardly bulged area bulged in a direction towards the upper section for nested contact with hand palm skin covering metacarpals of a person's hand palm for enabling the member to snugly fit around the hand of the person with an upper section of the clasping member being snugly engageable with a top hand surface of the hand on an opposite side of the metacarpals on the person's hand, the clasping member having an interior surface including the upper and inner sections which are shaped for snug fitted engagement about the person's hand with said inwardly bulged area serving to lock with an identical area of the hand palm to assist in holding the clasping member in place on the hand of the person, said C-shaped hand clasping member having adjacent ends, said bulged area being located at each of the ends with the ends being engageable within a superficial palmar arch in the hand palm to resist movement of the member when worn on a hand of a person, the upper section has opposed edges facing in opposite directions relative to one another, said edges being stepped to reduce the thickness with the upper section, having a tapered thickness with the thickest area being centrally located on the upper section and with the member being thinnest at areas where the member curves around opposite sides of the hand increasing comfort for a wearer.

13. The decorative C-shaped hand clasping member of claim 12 wherein the upper section has opposed edges facing in opposite directions relative to one another, said edges being stepped to reduce the thickness with the upper section having a tapered thickness with the thickest area being centrally located on the upper section and with the member being thinnest at areas where the member curves around opposite sides of the hand increasing comfort for a wearer.

14. A ring shaped member for hand wear on a hand of a person which comprises an inner ring shaped section and an upper ring shaped section, the inner ring shaped section having an inwardly bulged ring shaped area bulged in a direction towards the upper ring shaped section for nested contact with hand palm skin covering metacarpals of a person's hand palm for enabling the ring shaped member to snugly fit around the hand of the person with the upper ring shaped section of said ring shaped member being snugly engageable with a top hand surface of the hand on an opposite side of the metacarpals on the hand, said ring shaped member having an interior ring shaped surface including the upper and inner ring shaped sections which are shaped for snug fitted engagement about the hand with said inwardly bulged ring shaped area serving to lock with an identical area of the hand palm to assist in holding said ring shaped member in place on the hand of the person, the upper ring shaped section having opposed edges facing in opposite directions relative to one another, said edges being stepped to reduce the thickness with the upper ring shaped section having a tapered thickness with the thickest area being centrally located on the upper ring shaped section and with the upper ring shaped member being thinnest at areas where the upper ring shaped member curves around opposite sides of the hand increasing comfort for a wearer.

15. A decorative hand clasping member for hand wear on a hand of a person comprising an inner section and an upper section, the inner section having an inwardly bulged ring shaped area bulged in a direction towards the upper section for nested contact with hand palm skin covering metacarpals in a person's hand palm for enabling the member to snugly fit around the hand of the person, the inner section extending across the entire length of the person's hand palm with the upper section of said member being snugly engageable with a top hand surface of the hand on an opposite side of the metacarpals on the hand to substantially encase the outer perimeter of the top hand surface, said member having an interior surface including the upper and inner sections which are shaped for snug fitted engagement about the hand with said inwardly bulged ring shaped area serving to lock with an superficial palmar arch of the hand palm to assist in holding said member in place on the hand of the person.

* * * * *